US011963602B2

(12) United States Patent
Yan

(10) Patent No.: US 11,963,602 B2
(45) Date of Patent: Apr. 23, 2024

(54) PARTIALLY TREATED COSMETIC PRODUCT APPLICATOR

(71) Applicant: ELC MANAGEMENT LLC, Melville, NY (US)

(72) Inventor: Jian Yan, Kirkland (CA)

(73) Assignee: ELC MANAGEMENT LLC, Melville, NY (US)

( * ) Notice: Subject to any disclaimer, the term of this patent is extended or adjusted under 35 U.S.C. 154(b) by 0 days.

(21) Appl. No.: 17/879,327

(22) Filed: Aug. 2, 2022

(65) Prior Publication Data

US 2024/0041181 A1 Feb. 8, 2024

(51) Int. Cl.

| | |
|---|---|
| ***A45D 34/04*** | (2006.01) |
| ***A45D 40/26*** | (2006.01) |
| ***A46B 9/02*** | (2006.01) |
| ***A46B 17/08*** | (2006.01) |

(52) U.S. Cl.

CPC ..... *A45D 34/042* (2013.01); *A45D 40/262* (2013.01); *A46B 9/021* (2013.01); *A46B 17/08* (2013.01); *A45D 2200/10* (2013.01); *A46B 2200/1046* (2013.01)

(58) Field of Classification Search

CPC .. A45D 34/042; A45D 40/262; A45D 34/045; A45D 40/265; A46B 17/08; A46B 9/021; A46B 2200/1046; A46B 2200/10; A46B 9/02; A46B 9/026; A46B 3/00; A46B 3/02

USPC ..... 401/126–130

See application file for complete search history.

(56) References Cited

U.S. PATENT DOCUMENTS

| | | | | |
|---|---|---|---|---|
| 6,059,570 | A * | 5/2000 | Dragan | A61C 5/50 433/80 |
| 10,888,145 | B2 * | 1/2021 | Kukreja | A45D 40/265 |
| 11,064,798 | B2 | 7/2021 | Sanchez | |
| 11,523,672 | B2 | 12/2022 | Bose et al. | |

(Continued)

FOREIGN PATENT DOCUMENTS

| | | | |
|---|---|---|---|
| JP | 2006-094892 | A | 4/2006 |
| KR | 2019-0072787 | A | 6/2019 |
| KR | 2021-0097605 | A | 8/2021 |

OTHER PUBLICATIONS

International Application No. PCT/US2023/028510, International Search Report and Written Opinion, mailed Nov. 8, 2023.

*Primary Examiner* — David J Walczak
(74) *Attorney, Agent, or Firm* — MARSHALL, GERSTEIN & BORUN LLP

(57) ABSTRACT

Approaches for manufacturing an applicator and corresponding applicators for applying a cosmetic substance are provided that may include forming an applicator body, an applicator head, and a detachable shield. The applicator body includes a first end and a second end. The applicator head is operably coupled with the first end of the applicator body and includes an outer surface. The detachable shield being removably coupled with the applicator head. The outer surface of the applicator head is segmented into an exposed portion outside of the detachable shield and a shielded portion within the detachable shield. The approach further includes applying a surface treatment to the outer surface of the applicator head and removing the detachable shield from the applicator head. Upon removing the detachable shield, the shielded portion is free of the surface treatment.

20 Claims, 8 Drawing Sheets

(56) References Cited

U.S. PATENT DOCUMENTS

| | | | | |
|---|---|---|---|---|
| 2003/0217759 | A1* | 11/2003 | Kepka | A46B 3/02 300/21 |
| 2003/0235454 | A1* | 12/2003 | Gueret | A45D 40/267 401/122 |
| 2020/0329845 | A1 | 10/2020 | Bianco et al. | |
| 2020/0367631 | A1 | 11/2020 | Bianco | |
| 2020/0390222 | A1 | 12/2020 | Lee et al. | |

* cited by examiner

PARTIALLY TREATED COSMETIC PRODUCT APPLICATOR

FIELD OF THE DISCLOSURE

The present disclosure generally relates to cosmetic, hair care, body care, and/or skincare products and, more particularly, to product applicators and approaches for manufacturing such products.

BACKGROUND

Cosmetic, hair care, body care, and/or skincare products may be applied via a number of applicator products using any number of varying approaches and/or styles. As an example, a concealer product may be applied using a user's finger, an applicator brush, and/or a sponge product, among other alternatives. When applying such products, it may be desirable for a user to accurately apply the product to provide coverage for the desired area and to subsequently blend and/or perform other application steps using the same tool. While some applicators may include surface treatments such as flocking thereto that may assist in blending and/or other steps, it may be desirable for the applicator to include multiple regions having different surface treatments as a way to perform other application steps.

Existing manufacturing approaches may incorporate a surface treatment application step in which the surface treatment is applied to a portion of the applicator. However, such processes may be time consuming and oftentimes only allow for a linear cutoff region between treated and untreated portions of the applicator. Further, the complex geometry of some applicators may result in significant design limitations and lead to undesirable surface treatment regions. Further, some existing applicators incorporate multiple parts constructed from different materials as a way to provide applicators having varying surface treatments. However, such components of these applicators may experience deformation at differing rates, which in turn may cause unsightly and/or otherwise undesirable gaps on the applicator that may impact performance. While adhesives such as glue may be used to ensure the components do not separate, such a process may result in additional cost, processes, and waste.

Accordingly, there is a need for improved accessories having improved functionalities.

SUMMARY

Examples within the scope of the present disclosure are directed approaches for manufacturing an applicator and corresponding applicators for applying a cosmetic substance. Such approaches may include forming an applicator body, an applicator head, and a detachable shield. The applicator body includes a first end and a second end. The applicator head is operably coupled with the first end of the applicator body and includes an outer surface. The detachable shield is removably coupled with the applicator head. The outer surface of the applicator head is segmented into an exposed portion outside of the detachable shield and a shielded portion within the detachable shield. The approach further includes applying a surface treatment to the outer surface of the applicator head and removing the detachable shield from the applicator head. Upon removing the detachable shield, the shielded portion is free of the surface treatment.

In some examples, the step of applying a surface treatment to the outer surface of the applicator head includes applying a flocking material. In some examples, the approaches may further include the step of applying an adhesive to the exposed portion of the outer surface of the applicator head prior to applying the flocking material.

In these and other approaches, the step of applying a surface treatment to the outer surface of the applicator head includes at least one of applying a soft-touch material, applying a gloss material, applying a matte material, or applying a pigmentation. In some forms, the approach may further include the step of closing a distal end of the detachable shield to prevent the surface treatment from contacting the shielded portion of the outer surface of the applicator head. In these and other examples, the step of contacting the applicator head with the surface treatment further includes maintaining a portion of the detachable shield above an upper surface of the surface treatment to prevent the surface treatment from coming into contact with the shielded portion of the outer surface of the applicator head.

In some approaches, the applicator body, the applicator head, and the detachable shield are formed via a molding process. In some of these examples, the step of forming the detachable shield may include forming a weakened seam in a portion of the detachable shield.

In accordance with a second aspect, an applicator for applying a cosmetic substance is provided that includes an applicator body having a first end, a second end, and an elongated portion extending therebetween, an applicator head operably coupled with the first end of the applicator body, a detachable shield, and a surface treatment. The applicator head includes an outer surface adapted to collect and apply the cosmetic substance. The detachable shield is removably coupled with the applicator head such that the outer surface of the applicator head is segmented into an exposed portion outside of the detachable shield and a shielded portion within the detachable shield. The surface treatment is adapted to cover the exposed portion of the applicator head. Upon removing the detachable shield from the applicator head, the shielded portion is free of the surface treatment.

In accordance with a third aspect, an approach for manufacturing an applicator and corresponding applicators for applying a cosmetic substance. Such approaches may include forming an applicator head and a detachable shield. The applicator head includes an outer surface. The detachable shield is removably coupled with the applicator head. The outer surface of the applicator head is segmented into an exposed portion outside of the detachable shield and a shielded portion within the detachable shield. The approach further includes applying a surface treatment to the outer surface of the applicator head and removing the detachable shield from the applicator head. Upon removing the detachable shield, the shielded portion is free of the surface treatment.

BRIEF DESCRIPTION OF THE DRAWINGS

The above needs are at least partially met through provision of one, more than one, or any combination of the approaches for partially treated cosmetic product applicators described in the following detailed description, particularly when studied in conjunction with the drawings, wherein.

Figure 1:
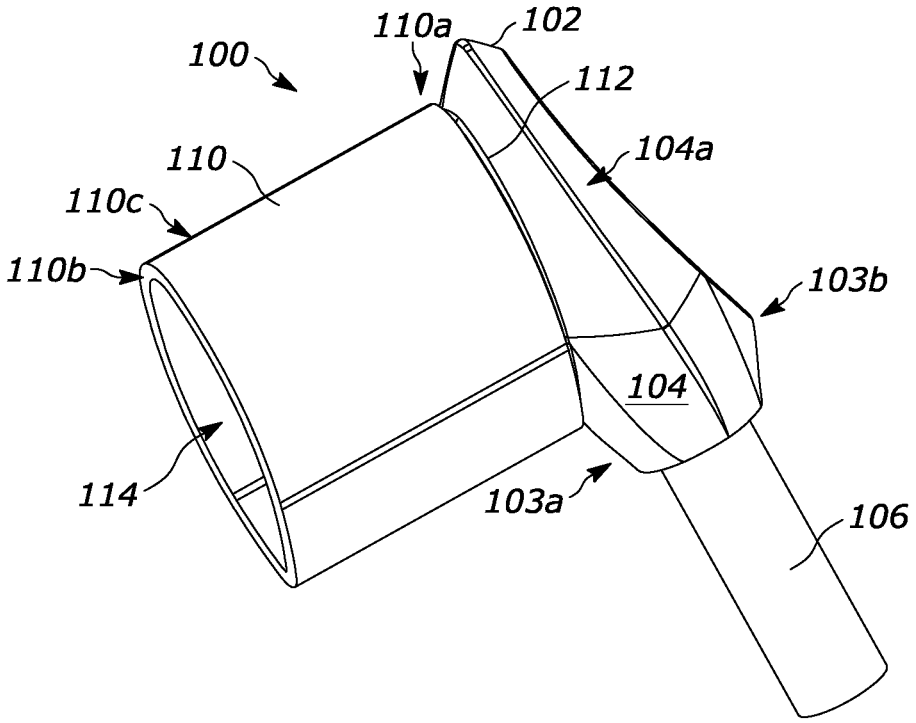
FIG. 1 illustrates a front side perspective view of an example product applicator in accordance with various examples.
Figure 2:
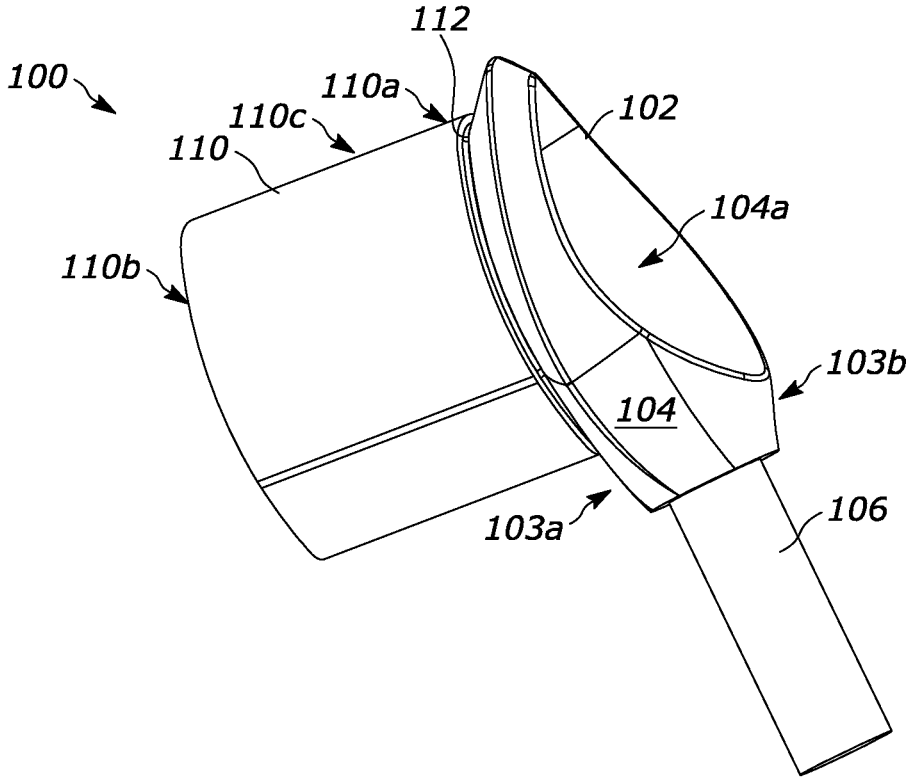
FIG. 2 illustrates a rear side perspective view of the example product applicator of FIG. 1 in accordance with various examples.
Figure 3:
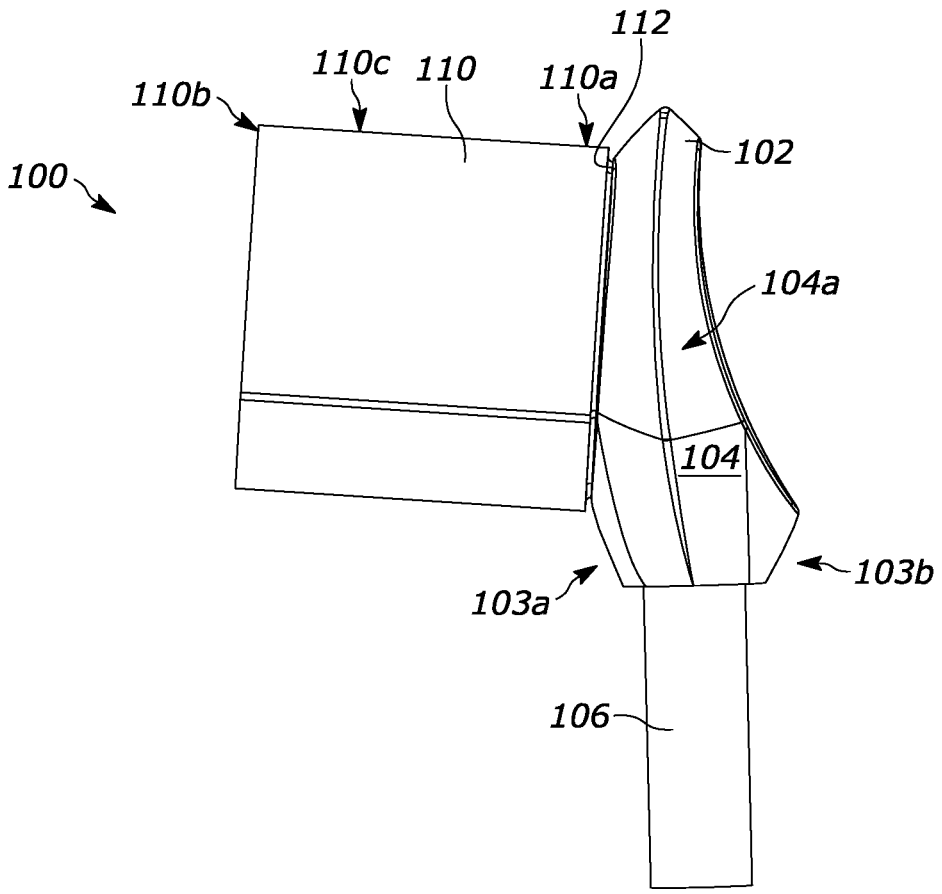
FIG. 3 illustrates a right side elevation view of the example product applicator of FIGS. 1 & 2 in accordance with various examples.

Skilled artisans will appreciate that elements in the figures are illustrated for simplicity and clarity and have not necessarily been drawn to scale. For example, the dimensions and/or relative positioning of some of the elements in the figures may be exaggerated relative to other elements to help to improve understanding of various examples. Also, common but well-understood elements that are useful or necessary in a commercially feasible examples are often not depicted in order to facilitate a less obstructed view of these various examples. It will further be appreciated that certain actions and/or steps may be described or depicted in a particular order of occurrence while those skilled in the art will understand that such specificity with respect to sequence is not actually required. It will also be understood that the terms and expressions used herein have the ordinary technical meaning as is accorded to such terms and expressions by persons skilled in the technical field as set forth above except where different specific meanings have otherwise been set forth herein.

DETAILED DESCRIPTION

Generally speaking, pursuant to these various approaches, a product applicator is provided that may be efficiently manufactured to allow for desired surface treatments to be applied to desired regions. The product applicator may accommodate any number of regions having varying shapes, sizes, or other configurations as desired to allow a user to precisely dispense and apply a quantity of a cosmetic, a hair care, a body care, a skincare, and/or any other product such as, for example, a lip gloss product, a concealer formula, and the like, and allows the product to be applied and blended in an ergonomic and even manner.

Turning to the Figures, an applicator 100 is provided for applying a product such as, for example, a cosmetic substance. The applicator 100 includes an applicator head 102, a detachable shield 110, and an applicator body 120. The applicator head 102 has an upper portion 103*a* and a lower portion 103*b* that cooperate to define an outer surface 104. The upper and lower portions 103*a*, 103*b* may have any number of desired shapes, geometries, and/or configurations to assist with applying the product in an ergonomic manner. The applicator head 102 further includes a neck portion 106 operably coupled therewith. In some examples, the neck portion 106 may include any number of body retention features 107 (FIGS. 6-8) to assist with coupling the applicator head 102 with the applicator body 120.

Figure 4:
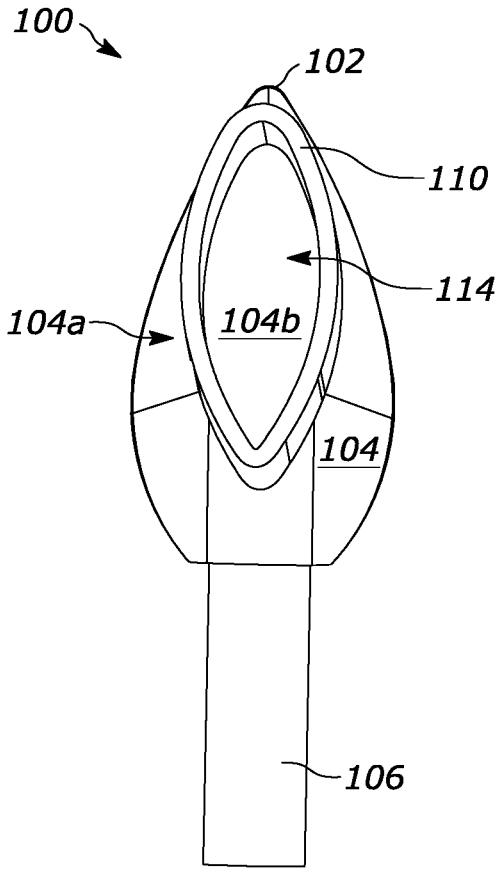
FIG. 4 illustrates a front side elevation view of the example product applicator of FIGS. 1-3 in accordance with various examples.
Figure 5:
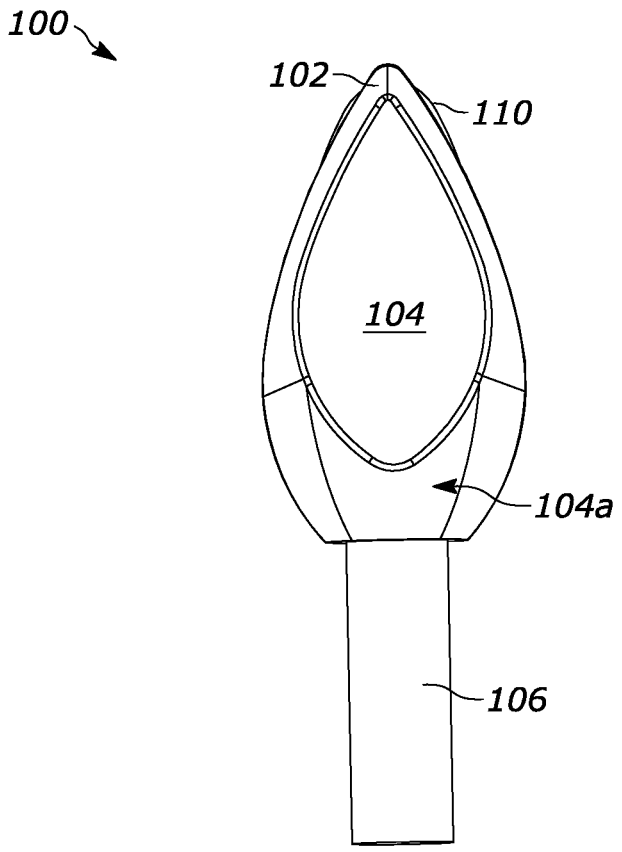
FIG. 5 illustrates a rear side elevation view of the example product applicator of FIGS. 1-4 in accordance with various examples.

The detachable shield 110 is removably coupled with the applicator head 102. In the illustrated examples, the detachable shield 110 is disposed at the upper portion 103*a* of the applicator head 102, but other arrangements are possible. The detachable shield 110 includes a proximal end 110*a* positioned adjacent to the applicator head 102, a distal end 110*b*, and an elongated length 110*c* extending therebetween. As illustrated in FIGS. 1 and 4, the detachable shield 110 may be in the form of a generally tubular member that defines any desired cross-sectional shape or arrangement. More specifically, while the illustrated examples depict the detachable shield 110 as having a generally ovoid cross-sectional shape, any desired shape, shapes, and/or configurations may be used.

In some examples, the detachable shield 110 is formed with the applicator head 102 via a single forming (e.g., molding, injection molding, additive manufacturing, etc.) process to reduce overall production costs. In some examples, the proximal end 110*a* of the detachable shield 110 may include a weakened seam 112 to assist with decoupling or removing the detachable shield 110 from the applicator head 102. Such weakened seam 112 may also be created during the forming process using any number of suitable approaches.

In the illustrated examples, the detachable shield 110 is generally hollow and has an interior cavity 114 defined by the elongated length 110*c*. The detachable shield 110 creates a shield, barrier, and/or a perimeter that segments the outer surface 104 into an exposed portion 104*a* (i.e., a portion outside of the detachable shield 110) and a shielded portion 104*b* (i.e., a portion within the detachable shield 110). In other words, the detachable shield 110 prevents or otherwise restricts substances from contacting the shielded portion 104*b* of the outer surface 104.

In some examples, the distal end 110*b* of the detachable shield 110 may be sealed or otherwise closed. More specifically, a sealing member 118 may be positioned at or near the distal end 110*b* of the detachable shield 110 to seal the cavity 114. In some examples, the sealing member 118 may be in the form of a clip or a plug. In other examples, the sealing member 118 may be in the form of a seam formed via heat sealing and the like. Other examples are possible.

It is to be appreciated that in other examples (not illustrated), the detachable shield 110 may be partially or entirely solid, and as such, may not require the use of a sealing member 118 to further restrict substances from contacting the shielded portion 104*b* of the outer surface 104.

Figure 9:
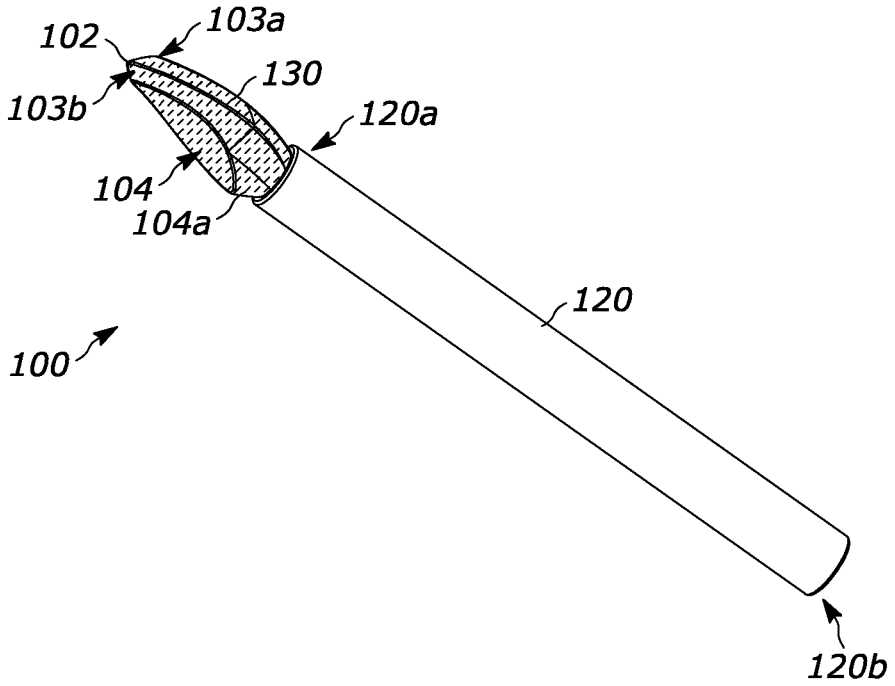
FIG. 9 illustrates a perspective view of the example product applicator of FIGS. 1-8 in an assembled state in accordance with various examples.
Figure 10:
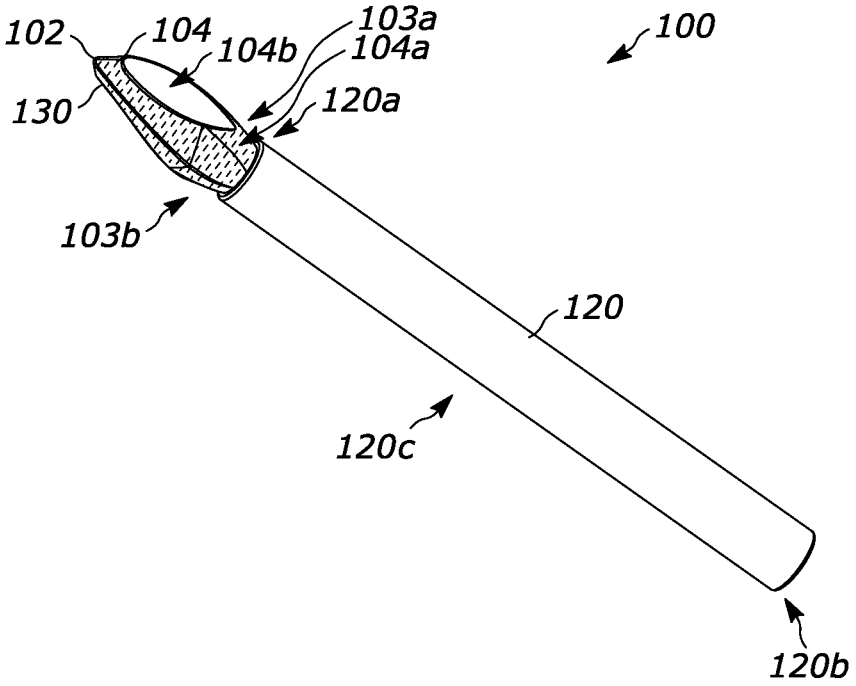
FIG. 10 illustrates a perspective view of the example product applicator of FIGS. 1-10 in an assembled state in accordance with various examples.

The applicator body 120 includes a first end 120*a*, a second end 120*b*, and an elongated portion 120*c* therebetween. The applicator body 120 may be used as a handle by a user by holding the elongated portion 120*c* thereof when applying the product. As illustrated in FIGS. 9 and 10, the applicator head 102 (e.g., the body retention feature 107) may be operably coupled with the first end 120*a* of the applicator body 120 via any number of suitable approaches such as, for example, a friction-fit coupling, a threaded coupling, and the like. Other examples are possible. In some approaches, the applicator body 120 may be integrally formed with the applicator head 102 and the detachable shield 110 during a single forming process, such as, for example, one or ones of the previously-described forming processes. Other examples are possible.

Figure 6:
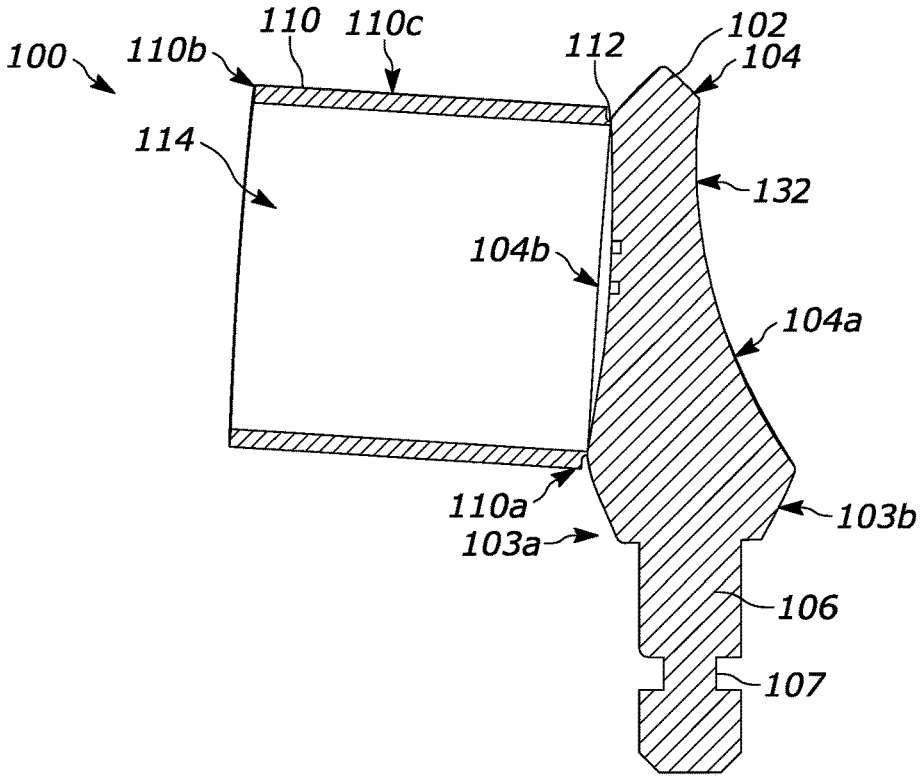
FIG. 6 illustrates a right side cross-sectional elevation view of the example product applicator of FIGS. 1-5 in accordance with various examples.
Figure 7:
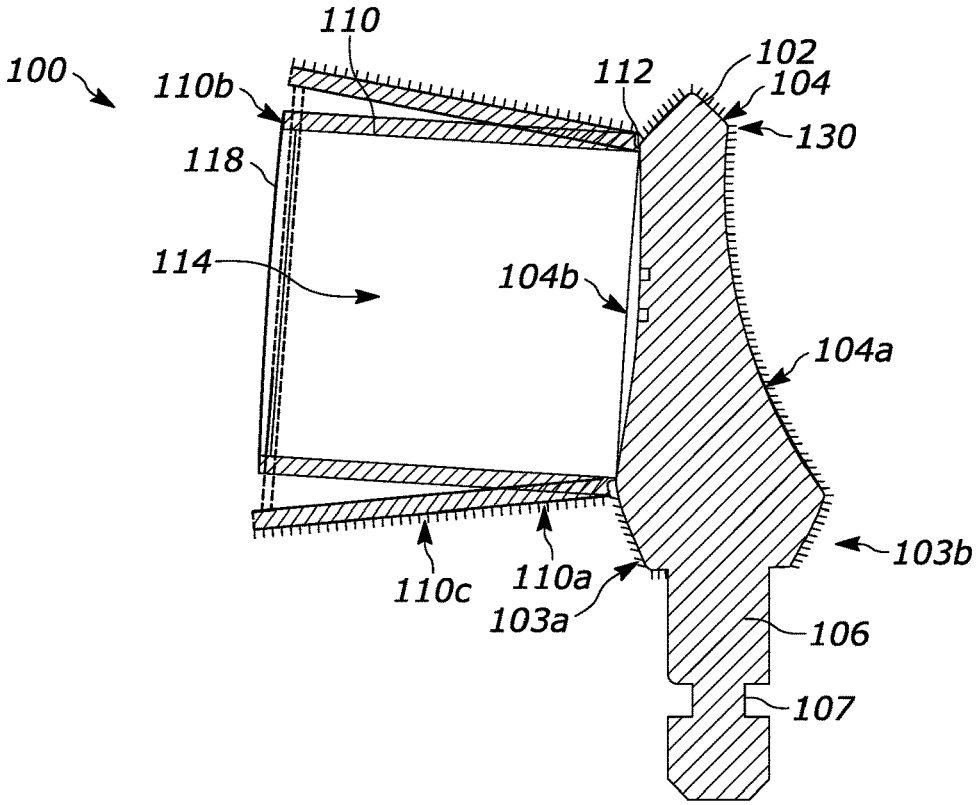
FIG. 7 illustrates a right side cross-sectional elevation view of the example product applicator of FIGS. 1-6 having an example surface treatment applied thereto in accordance with various examples.

Turning to FIGS. 6-10, the outer surface 104 of the applicator head 102 may have a surface treatment 130 applied thereto. In some examples, the surface treatment 130 may be in the form of a flocking material. In other examples, the surface treatment 130 may be in the form of a soft-touch material, a glossy material, a matte material, and/or a pigmentation. Any combination of these surface treatments 130 may be applied to the outer surface 104 of the applicator head. As illustrated in FIG. 6, the applicator head 102 and the detachable shield 110 are operably coupled together prior to applying the surface treatment 130. As illustrated in FIG. 7, the surface treatment 130 may be applied to the entire applicator head 102 via any number of suitable approaches. For example, in one approach, the surface treatment 130 may be in the form of a submersible material that the applicator head 102 and the detachable shield 110 may be submerged into. In examples where the distal end 110*b* of the detachable shield 110 is closed or otherwise sealed, the entire detachable shield 110 may also be submerged into the surface treatment 130. However, in examples where the distal end 110*b* of the detachable shield 110 is open, the detachable shield 110 may include an upper extension region (not illustrated) that may remain outside of the surface treatment 130 upon contacting the applicator head 102 with the surface treatment 130. Such a configuration may resemble a snorkel or similar arrangement.

In other examples, the surface treatment 130 (e.g., a flocking material or fiber) may be electrically and/or magnetically pre-charged, and the applicator head 102 may be disposed in an environment while being electrically and/or magnetically pre-charged with the opposite pole or charge. The surface treatment 130 may then be dropped or otherwise dispensed on and around the applicator head 102, whereupon the opposite polarities and/or charges may cause the surface treatment 130 to become coupled with the exposed portion 104*a* of the outer surface 104 of the applicator head 102 while extending or projecting perpendicularly from the outer surface 104. In some of these examples, an adhesive or other depositive layer 132 may be applied to the outer surface 104 prior to applying the surface treatment 130 to assist with adhesion. In these and other examples, the applicator head 102 may be disposed in an enclosure that forms a vacuum to cause the surface treatment 130 to be drawn to the applicator head 102.

Figure 8:
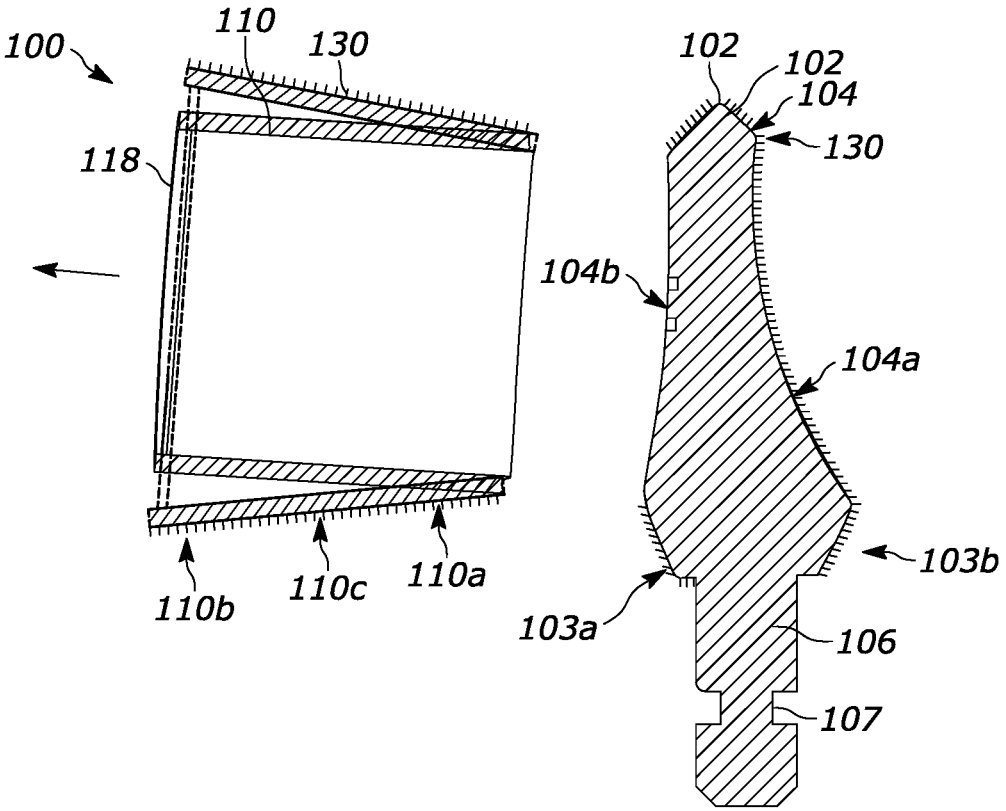
FIG. 8 illustrates a right side cross-sectional elevation view of the example product applicator of FIGS. 1-7 having an example surface treatment applied thereto and being decoupled from an example shield in accordance with various examples.

As illustrated in FIG. 7, upon applying the surface treatment 130 to the outer surface 104 of the applicator head 102, the exposed portion 104*a* will become at least partially covered with the surface treatment 130. In some examples, a portion of the surface treatment 130 may contact or otherwise adhere to the detachable shield 110. However, the detachable shield 110 prevents the surface treatment 130 from contacting the shielded portion 104*b* of the outer surface 104, and as such, the shielded portion 104*b* will remain free of surface treatment 130. As illustrated in FIGS. 8 and 10, the detachable shield 110 may be removed from the applicator head 102, whereupon the shielded portion 104*b* may become exposed and free of surface treatment 130.

During use, a user may collect a quantity of product on the applicator head 102 (e.g., by submerging the applicator head 102 within a container or similar reservoir containing the product), whereupon the product may be temporarily adhered to the outer surface 104 of the applicator head. In some examples, the varying surface treatments of the exposed and shielded portions 104*a*, 104*b* may selectively assist with applying, blending, mixing, and/or performing any other desired application steps. As such, these regions may be incorporated into a user's regimen to perform different application steps that may or may not be benefitted by the use of the surface treatment 130.

In examples where the applicator head 102 is not formed with the applicator body 120, these components may be operably coupled with each other for final assembly.

So configured, the system provides for an efficient manufacturing process that does not require additional protection to achieve treated and untreated regions. Further, the approaches described herein are not constrained by conventional design limitations and their application to various regions of the applicator. The applicator may be constructed from a single material during a single manufacturing process, thereby reducing production costs and times.

It is to be appreciated that any number of alternative arrangements and/or designs may be provided that incorporate the teachings of this disclosure. As an example, a number of detachable shields 110 may be provided to form multiple untreated portions of the outer surface 104. Further, while the detachable shield 110 is positioned at the upper portion 103*a* in the illustrated examples, a detachable shield or shields may be positioned at any other location along the applicator head 102 as desired.

It is to be appreciated that while the example cosmetic products and cosmetic product containers illustrated in the figures are in the form of lipstick or lip gloss products, the approaches described herein may be suitable for any number of products including cosmetic products, hair care products, body care products, skincare products, and the like. Further, in some examples, the steps for forming a component or object of any sort may incorporate the teaching of the present disclosure. For example, an object or a body having any desired form or use may be constructed using any suitable approach (e.g., via molding, additive manufacturing, etc.). During this forming process, a detachable shield having any desired configuration or arrangement may be formed therewith (or in some examples, operably coupled with the object). A desired surface treatment may be applied to a particular exposed region or surface (e.g., an outer surface, an inner surface, or any surface or area) while the detachable shield may prevent the desired surface treatment from contacting a shielded region of the object. The detachable shield may subsequently be removed from the object to expose a shielded region that does not contain the desired surface treatment. Other examples are possible.

In the foregoing specification, specific embodiments have been described. However, one of ordinary skill in the art appreciates that various modifications and changes can be made without departing from the scope of the invention as set forth in the claims below. Accordingly, the specification and figures are to be regarded in an illustrative rather than a restrictive sense, and all such modifications are intended to be included within the scope of present teachings. Additionally, the described embodiments/examples/implementations should not be interpreted as mutually exclusive, and should instead be understood as potentially combinable if such combinations are permissive in any way. In other words, any feature disclosed in any of the aforementioned embodiments/examples/implementations may be included in any of the other aforementioned embodiments/examples/implementations.

The benefits, advantages, solutions to problems, and any element(s) that may cause any benefit, advantage, or solution to occur or become more pronounced are not to be construed as a critical, required, or essential features or elements of any or all the claims. The claimed invention is defined solely by the appended claims including any amendments made during the pendency of this application and all equivalents of those claims as issued.

Moreover in this document, relational terms such as first and second, top and bottom, and the like may be used solely to distinguish one entity or action from another entity or action without necessarily requiring or implying any actual such relationship or order between such entities or actions. The terms "comprises," "comprising," "has", "having," "includes", "including," "contains", "containing" or any other variation thereof, are intended to cover a non-exclusive inclusion, such that a process, method, article, or apparatus that comprises, has, includes, contains a list of elements does not include only those elements but may include other elements not expressly listed or inherent to such process, method, article, or apparatus. An element proceeded by "comprises . . . a", "has . . . a", "includes . . . a", "contains . . . a" does not, without more constraints, preclude the existence of additional identical elements in the process, method, article, or apparatus that comprises, has, includes, contains the element. The terms "a" and "an" are defined as one or more unless explicitly stated otherwise herein. The terms "substantially", "essentially", "approximately", "about" or any other version thereof, are defined as being close to as understood by one of ordinary skill in the art, and in one non-limiting embodiment the term is defined to be within 10%, in another embodiment within 5%, in another embodiment within 1% and in another embodiment within 0.5%. The term "coupled" as used herein is defined as connected, although not necessarily directly and not necessarily mechanically. A device or structure that is "configured" in a certain way is configured in at least that way, but may also be configured in ways that are not listed.

The Abstract of the Disclosure is provided to allow the reader to quickly ascertain the nature of the technical disclosure. It is submitted with the understanding that it will not be used to interpret or limit the scope or meaning of the claims. In addition, in the foregoing Detailed Description, it can be seen that various features are grouped together in various embodiments for the purpose of streamlining the disclosure. This method of disclosure is not to be interpreted as reflecting an intention that the claimed embodiments require more features than are expressly recited in each claim. Rather, as the following claims reflect, inventive subject matter may lie in less than all features of a single disclosed embodiment. Thus, the following claims are hereby incorporated into the Detailed Description, with each claim standing on its own as a separately claimed subject matter.

The patent claims at the end of this patent application are not intended to be construed under 35 U.S.C. § 112(f) unless traditional means-plus-function language is expressly recited, such as "means for" or "step for" language being explicitly recited in the claim(s).

What is claimed is:

1. A method of manufacturing an applicator for applying a cosmetic substance, the method comprising:

forming an applicator body, an applicator head, and a detachable shield, the applicator body including a first end and a second end, the applicator head being operably coupled with the first end of the applicator body and including an outer surface, the detachable shield being removably coupled with the applicator head;

wherein the outer surface of the applicator head is segmented into an exposed portion outside of the detachable shield and a shielded portion within the detachable shield;

applying a surface treatment to the outer surface of the applicator head; and removing the detachable shield from the applicator head, wherein upon removing the detachable shield, the shielded portion is free of the surface treatment.

2. The method of claim 1, wherein the step of applying a surface treatment to the outer surface of the applicator head comprises applying a flocking material.

3. The method of claim 2, further comprising the step of applying an adhesive to the exposed portion of the outer surface of the applicator head prior to applying the flocking material.

4. The method of claim 1, wherein the step of applying a surface treatment to the outer surface of the applicator head comprises at least one of applying a soft-touch material, applying a gloss material, applying a matte material, or applying a pigmentation.

5. The method of claim 1, further comprising the step of closing a distal end of the detachable shield to prevent the surface treatment from contacting the shielded portion of the outer surface of the applicator head.

6. The method of claim 1, wherein the step of applying the surface treatment further includes maintaining a portion of the detachable shield above a surface of the surface treatment to prevent the surface treatment from coming into contact with the shielded portion of the outer surface of the applicator head.

7. The method of claim 1, wherein the applicator body, the applicator head, and the detachable shield are formed via a molding process.

8. The method of claim 7, wherein the step of forming the detachable shield includes forming a weakened seam in a portion of the detachable shield.

9. An applicator for applying a cosmetic substance, the applicator comprising:

an applicator body including a first end, a second end, and an elongated portion extending therebetween;

an applicator head operably coupled with the first end of the applicator body, the applicator head including an outer sur face adapted to collect and apply the cosmetic substance and a neck portion operably coupled therewith to couple the applicator head with the first end of the applicator body;

a detachable shield removably coupled with the applicator head such that the outer surface of the applicator head is segmented into an exposed portion outside of the detachable shield and a shielded portion within the detachable shield; and a surface treatment adapted to cover the exposed portion of the applicator head;

wherein upon removing the detachable shield from the applicator head, the applicator head remains coupled with the first end of the applicator body and the shielded portion is free of the surface treatment.

10. The applicator of claim 9, wherein the surface treatment comprises a flocking material.

11. The applicator of claim 10, wherein the flocking material is adapted to cover the exposed portion of the applicator head by submerging at least a portion of the applicator head into the flocking material.

12. The applicator of claim 9, further comprising a depositive layer adapted to cover the outer surface of the applicator head to retain the surface treatment on the applicator head.

13. The applicator of claim 9, wherein at least a portion of the detachable shield is adapted to be contacted by the surface treatment upon applying the surface treatment to the applicator head.

14. The applicator of claim 13, wherein the detachable shield comprises a tube having an elongated length and a distal end.

15. The applicator of claim 14, wherein the elongated length of the detachable shield includes an upper extension region, the upper extension region adapted to remain outside of the surface treatment upon contacting the applicator head with the surface treatment.

16. The applicator of claim 14, wherein the distal end of the tube is closed via a sealing member.

17. The applicator of claim 9, wherein the shielded portion of the outer surface of the applicator head is formed on an upper surface of the applicator head at or near a distal end thereof.

18. The applicator of claim 9, wherein the surface treatment comprises at least one of a soft-touch material, a gloss material, a matte material, or a pigmentation.

19. A method of manufacturing an applicator for applying a cosmetic substance, the method comprising:

forming an applicator head and a detachable shield, the applicator head including an outer surface, the detachable shield being removably coupled with the applicator head;

wherein the outer surface of the applicator head is segmented into an exposed portion outside of the detachable shield and a shielded portion within the detachable shield;

applying a surface treatment to the outer surface of the applicator head; and removing the detachable shield from the applicator head, wherein upon removing the detachable shield, the shielded portion is free of the surface treatment.

20. The method of claim 19, further comprising the step of coupling the applicator head with a first end of an applicator body.

* * * * *